US008206189B2

(12) United States Patent
Kanda

(10) Patent No.: US 8,206,189 B2
(45) Date of Patent: Jun. 26, 2012

(54) INNER TERMINAL

(75) Inventor: Hidenori Kanda, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/003,901

(22) PCT Filed: Jul. 14, 2009

(86) PCT No.: PCT/JP2009/062749
§ 371 (c)(1),
(2), (4) Date: Jan. 13, 2011

(87) PCT Pub. No.: WO2010/007992
PCT Pub. Date: Jan. 21, 2010

(65) Prior Publication Data

US 2011/0124249 A1 May 26, 2011

(30) Foreign Application Priority Data

Jul. 14, 2008 (JP) ..... 2008-182281

(51) Int. Cl.
*H01R 9/24* (2006.01)

(52) U.S. Cl. ..... 439/885; 439/862

(58) Field of Classification Search ..... 439/862, 439/884, 885
See application file for complete search history.

(56) References Cited

U.S. PATENT DOCUMENTS 5,695,348 A * 12/1997 Legrady ..... 439/78
5,807,126 A 9/1998 Bethurum
6,533,591 B1 * 3/2003 Lee ..... 439/83
6,860,766 B2 * 3/2005 Aujla et al. ..... 439/733.1
7,682,207 B2 * 3/2010 Clark ..... 439/885
7,927,159 B2 * 4/2011 Zhang et al. ..... 439/885
2002/0146944 A1 * 10/2002 Akiyama ..... 439/862
2010/0248557 A1 * 9/2010 Fan ..... 439/816
2011/0124249 A1 * 5/2011 Kanda ..... 439/885

FOREIGN PATENT DOCUMENTS

JP 10-228962 A 8/1998
JP 2002-033161 A 1/2002
JP 2003-031333 A 1/2003

OTHER PUBLICATIONS

International Search Report, dated Sep. 29, 2009, issued in Application No. PCT/JP2009/062749.

* cited by examiner

*Primary Examiner* — James Harvey
(74) *Attorney, Agent, or Firm* — Sughrue Mion, PLLC

(57) ABSTRACT

There is provided an inner terminal capable of providing enhanced reliability of connection in a circuit board. There is also provided an inner terminal capable of providing enhanced high-frequency characteristics by appropriately adjusting impedance. An expanded part (31) for carrier-disconnection is integrally formed with an interconnecting part (27) of an inner terminal (21). The expanded part (31) is formed to be expanded from opposite sides of a horizontal part (29). Also, the expanded part (31) is formed in a plate shape having the same thickness as the horizontal part (29) and also having the front and rear sides which are flush with the horizontal part (29). The expanded part (31) is formed such that edges of the expansion serve as parts at which the inner terminal is disconnected from the carrier when the terminal is produced.

7 Claims, 5 Drawing Sheets

INNER TERMINAL

TECHNICAL FIELD

The present invention relates to an inner terminal which configures a coaxial connector for circuit board, which is provided on a circuit board.

BACKGROUND ART

A coaxial cable compatible with a high frequency is used to transmit high frequency signals. In an end of the coaxial cable, a plug type coaxial connector is provided. The plug type coaxial connector is configured to be electrically connected to a receptacle type coaxial connector (a coaxial connector for a circuit board) provided on a circuit board.

A receptacle type coaxial connector disclosed in Patent Literature 1 includes an inner terminal which is soldered on a signal pattern on a circuit board, a dielectric body in which the inner terminal is contained, an outer terminal provided to cover the dielectric body, and a housing to which the plug type coaxial connector is engaged.

The inner terminal includes an electric contact to be connected to a mating inner terminal of the plug type coaxial connector, a circuit board connection part to be soldered on the circuit board, and a plate-like interconnecting part which interconnects the electric contact and the circuit board connection part. The inner terminal is subjected to plating. The interconnecting part is formed usually to be elongated with the same in width as the circuit board connection part (Since the inner terminal itself is relatively small, the interconnecting part is to be narrow and elongated).

Citation List

Patent Literature

Patent Literature 1: JP-A-2002-33161

SUMMARY OF INVENTION

Technical Problem

The inner terminal has a problem that the sufficient connection strength may not be secured when the inner terminal is soldered on the signal pattern on the circuit board.

This problem is described with reference to FIG. 3. An inner terminal is disconnected from a carrier 2 during a producing process. In a case where a carrier-disconnection position 3 is set between a circuit board connection part 4 and the carrier 2, if the inner terminal 1 is disconnected from the carrier-disconnection position 3, an end face 5 of the circuit board connection part 4 becomes a cutting face, and the inner terminal 1 is forced in a state where the plating is disappeared. Consequently, a solder cannot be put, as intended, at a position of the end face 5 of the circuit board connection part 4 on a circuit board 4. As a result, a fillet 7 which is spread as shown in FIG. 4 cannot be formed. Thus, it becomes difficult to ensure the sufficient connection strength, which is the problem (that is, it is said that the reliability of board connection is low).

If the carrier-disconnection position 3 is set at a position where an interconnecting part 8 is located in the inner terminal 1 as shown in FIG. 5 in order to solve the problem, the fillet 7 (see FIG. 4) is formed and the sufficient connection strength is secured since the plating exists. However, in a process of disconnecting the inner terminal 1 at the carrier-disconnection position 3 after the circuit board connection part 4 and the signal pattern are soldered, a force applied during the disconnection may be transmitted to the soldered part. In a case where the force during the disconnection is applied, there occurs a deformation in the soldered part, which is a problem (A width of the soldered part is about 0.5 mm, for example, and the soldered part is extremely thin and is likely deformed. That is, it is said that the reliability of board connection is low).

Alternatively, in a case where the carrier-disconnection position 3 is set between an electric contact 9 and the carrier 2 as shown in FIG. 6, there is a problem that if there remains a burr during the disconnection, the burr scratches anything when the inner terminal is connected to a mating inner terminal.

Regarding the inner terminal, although not shown in figures, there is also a problem that disturbance of the impedance may occur at a position of the interconnecting part 8, etc. in a state where the coaxial connector is disposed on the circuit board, and the reduction of the high frequency performance is concerned.

In consideration with the above circumstances, the present invention aims at providing an inner terminal capable of enhancing the reliability of the board connection. The present invention also aims at providing an inner terminal capable of enhancing the high frequency characteristics by appropriately adjusting impedance.

Solution to Problem

An inner terminal according to an aspect of the invention to achieve the above problems is an inner terminal which configures a coaxial connector for a circuit board, which is to be provided on the circuit board, the inner terminal including: an electric contact to be connected to a mating inner terminal; a connection part to be soldered to the circuit board; an interconnecting part which interconnects the electric contact and the connection part; and an expanded part for carrier-disconnection which is expanded from opposite sides of the interconnecting part, wherein edges of the expansion serve as parts at which the inner terminal is disconnected from a carrier during a terminal-production.

According to the invention having the feature, since the carrier-connection/disconnection part is not located correspondingly to the circuit board connection part, the plating subjected to the inner terminal is not disappeared and if the connection by solder to the circuit board is performed, the fillet is firmly formed. Therefore, the sufficient connection strength is ensured. Further, according to the invention, since the carrier-connection/disconnection part is located at the expanded part for carrier-disconnection having an expanded plate shape, the force applied in the disconnection is not transmitted the part of the solder because of the strength of the expanded part. As a result, the deformation is not occurred in the part of the solder. Accordingly, the sufficient connection strength is ensured.

The expanded part may have a function of adjusting an impedance in accordance with its area.

According to the invention having the feature, the disturbance of the impedance is suppressed to the minimum by adjusting the area of the expanded part for carrier-disconnection.

The interconnecting part may include the electric contact, a horizontal part provided in parallel with the connection part, and a vertical part provided at right angles to the horizontal part.

The expanded part may be located in the horizontal part of the interconnecting part.

The expanded part may be the same in thickness as the interconnecting part and is flush with the interconnecting part.

The expanded part may be formed of a circular shape.

The expanded part may be formed of a rectangular shape.

Advantageous Effects of Invention

According to the configuration, it brings an advantage that the connection strength according to the solder with the circuit board can be sufficiently ensured. Accordingly, it brings an advantage to enhance the reliability of the board connection than usual.

According to the configuration, it brings an advantage that the impedance can be adjusted. Accordingly, it brings an advantage to suppress the disturbance of the impedance to the minimum and enhance the high frequency characteristics than usual.

DESCRIPTION OF EMBODIMENTS

Figure 1:
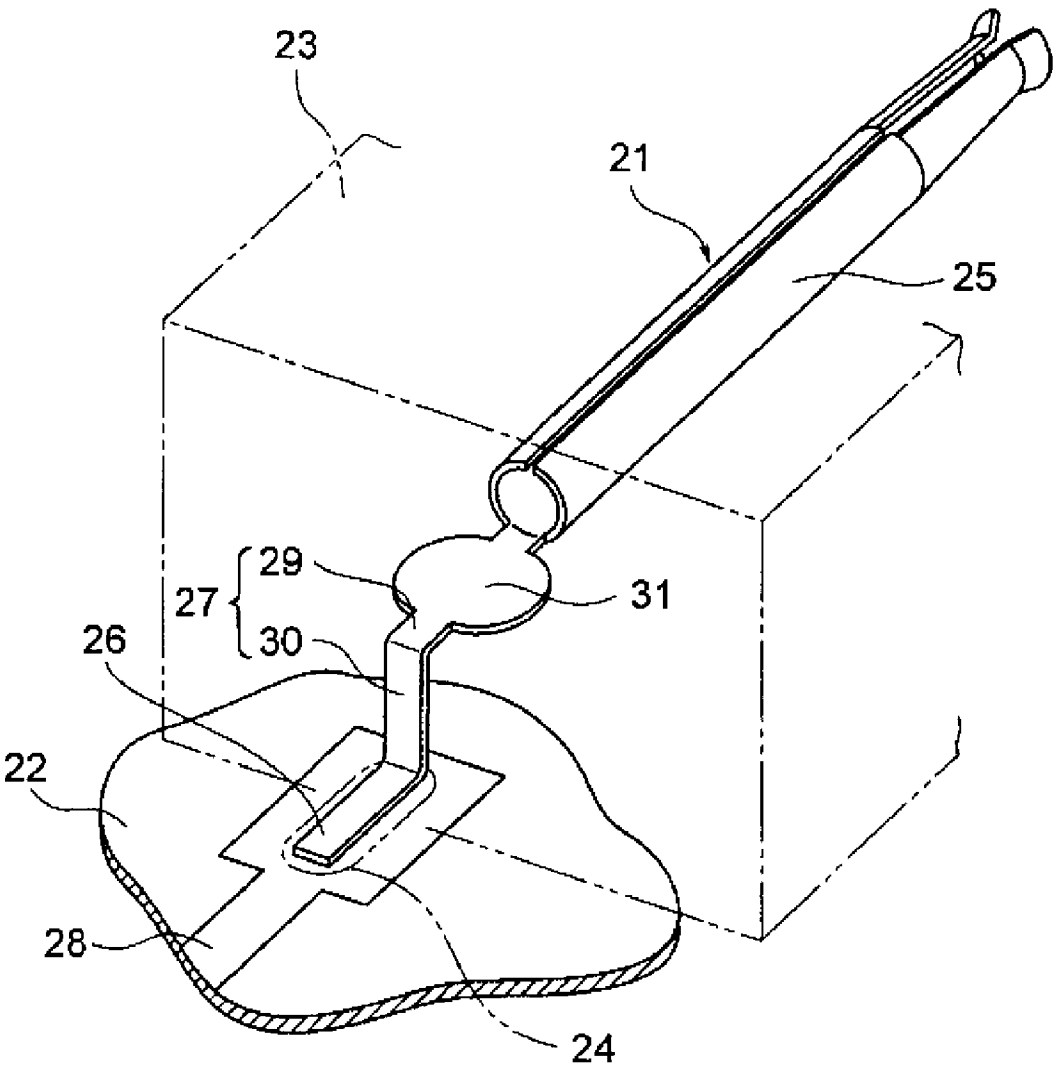
FIG. 1 is a perspective view of an inner terminal according to an embodiment of the invention.
Figure 2:
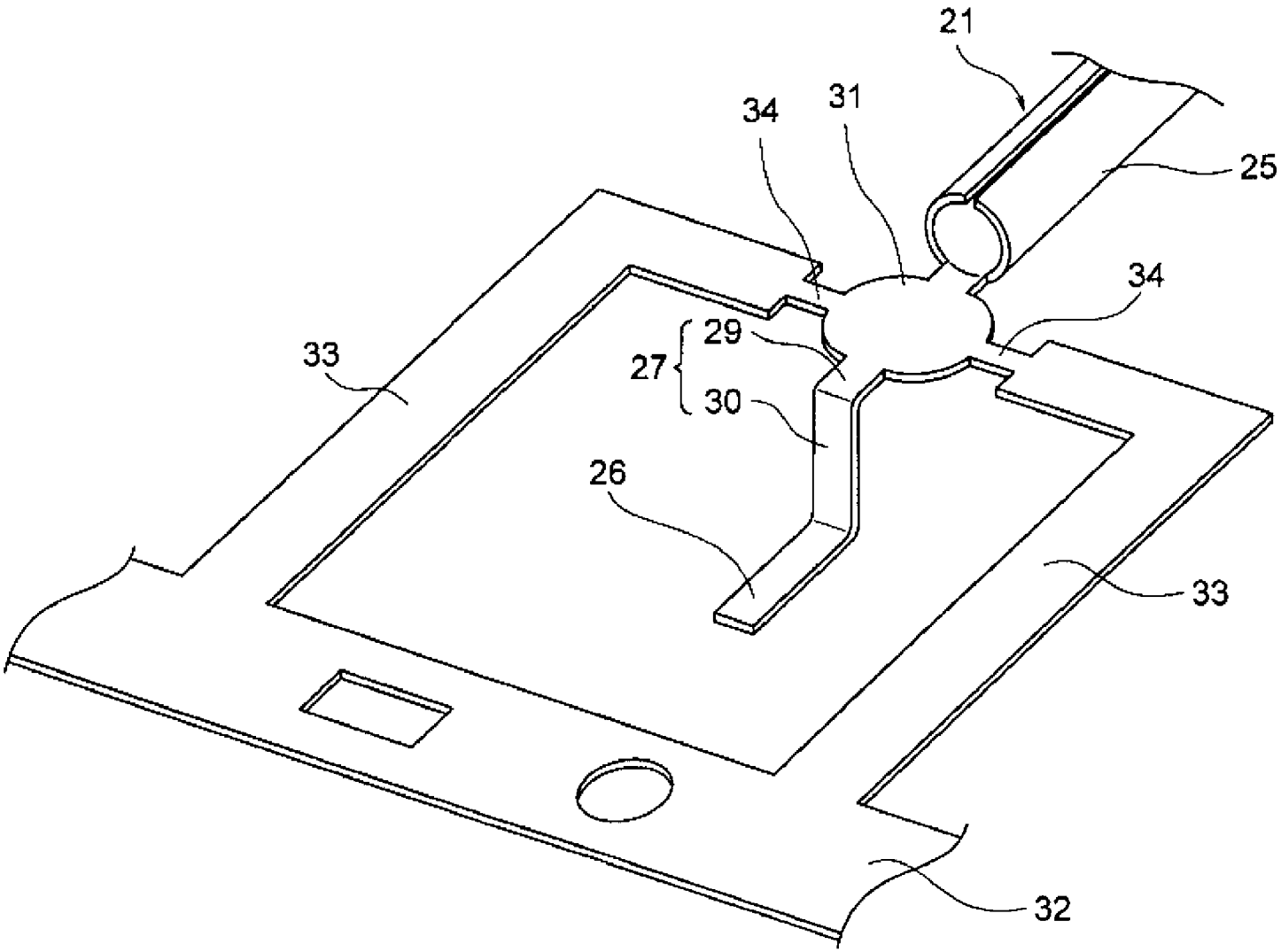
FIG. 2 is a perspective view of the inner terminal in a state it is connected to a carrier.
Figure 3:
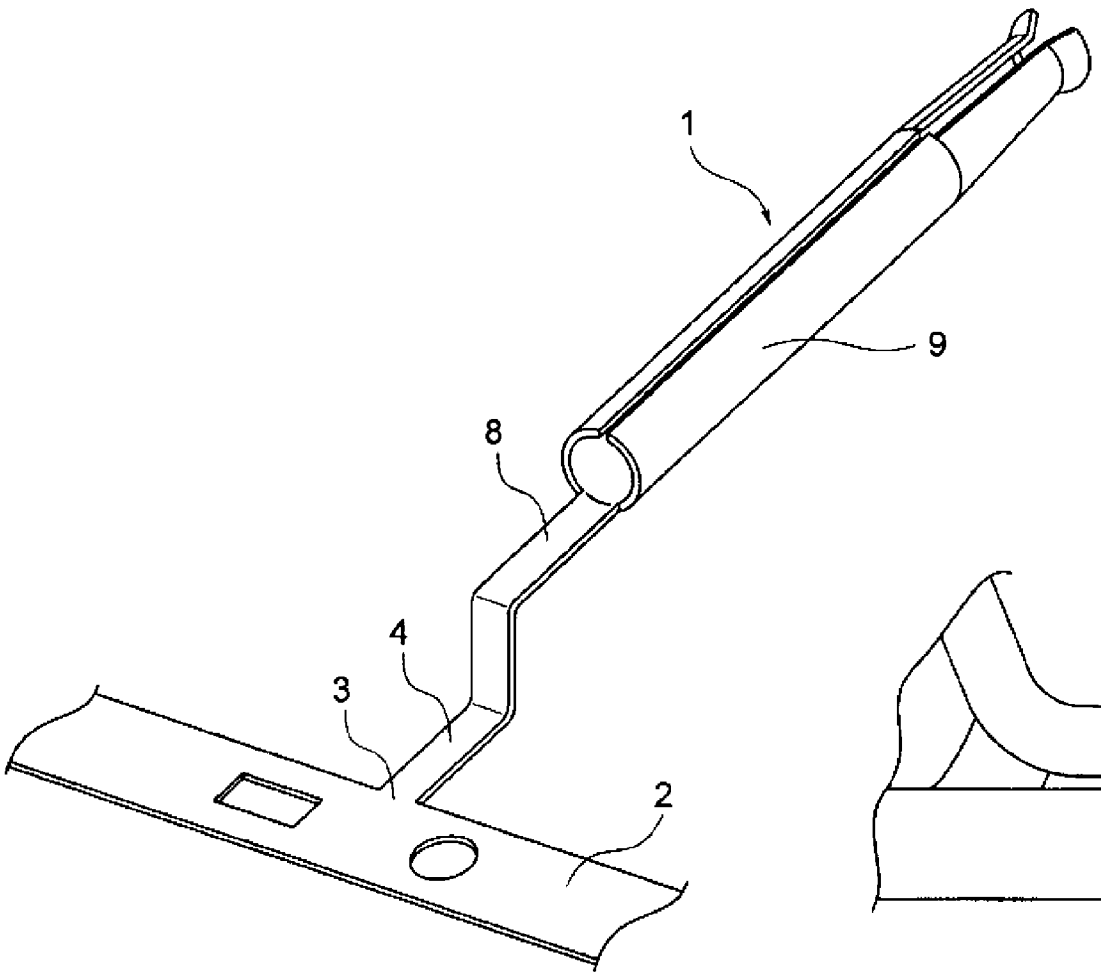
FIG. 3 is a perspective view of an inner terminal of a related art in a state where it is connected to a carrier.

Hereinafter, a description is made with reference to drawings. FIG. 1 is a perspective view of an inner terminal according to an embodiment of the invention. FIG. 2 is a perspective view of the inner terminal in a state it is connected to a carrier.

In FIG. 1, an inner terminal 21 according to the embodiment corresponds to a one component configuring a coaxial connector 23 for circuit board disposed on a circuit board 22. The inner terminal 21 is formed in a shape shown in the figure by pressing a metal plate having an electric conductivity (The female shape is one example. It may be formed in a pin-like male shape). The inner terminal 21 is configured so that the sufficient connection strength related to a soldering with the circuit board 22 can be ensured. In addition, the inner terminal 21 also has enhanced high frequency characteristics compared with the related art. First, the structure of the inner terminal 21 is described.

The inner terminal 21 includes an electric contact 25, a circuit board connection part 26, and an interconnecting part 27 which interconnects the electric contact 25 and the circuit board connection part 26. The inner terminal 21 is subjected to plating. The electric contact 25 serves as a part to be connected to a mating inner terminal of a mating coaxial connector (not shown in figures) which is a connection mate of the coaxial connector 23 for circuit board. The electric contact 25 is formed in a tube having an diameter-expandable elasticity (The mating inner terminal is formed in a pin-like male shape).

Figure 4:
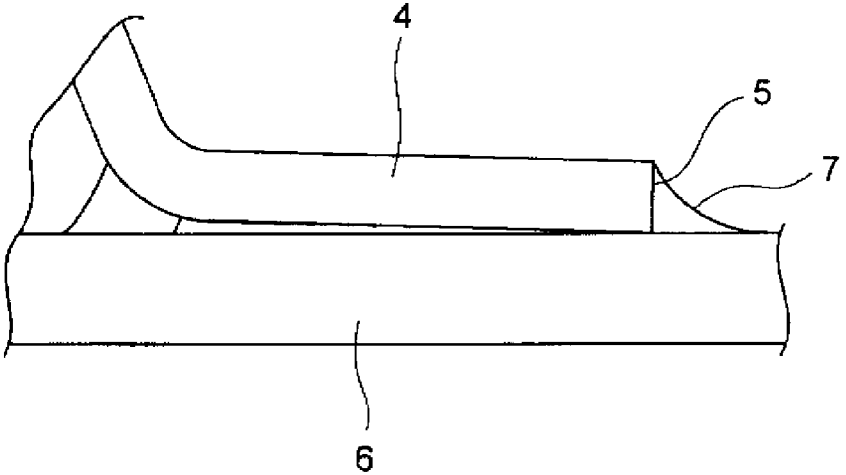
FIG. 4 is a side view showing a state where the inner terminal is soldered on a circuit board.
Figure 5:
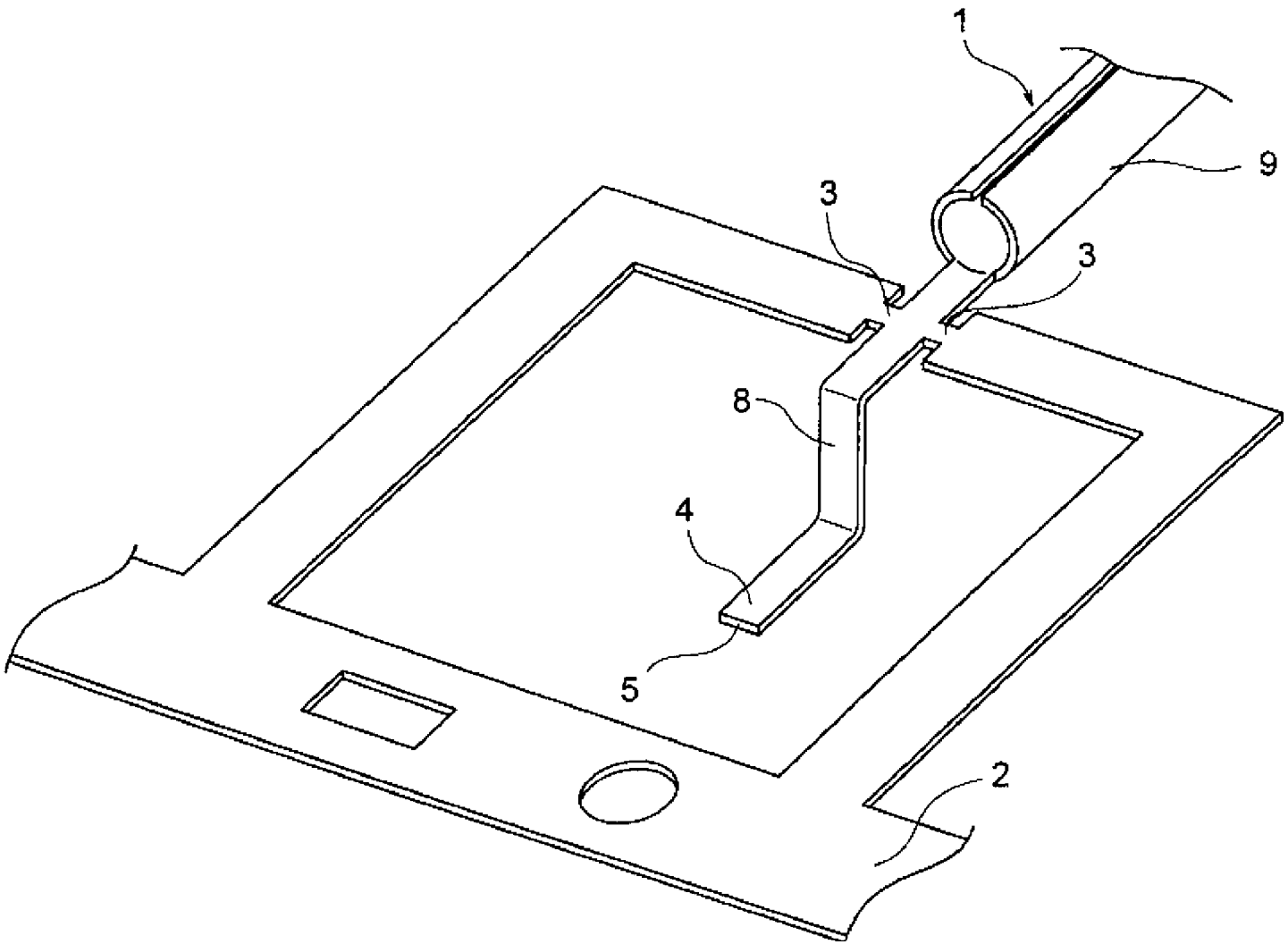
FIG. 5 is a perspective view of an inner terminal of a related art in a state where a connection position to the carrier is modified to a interconnecting part.
Figure 6:
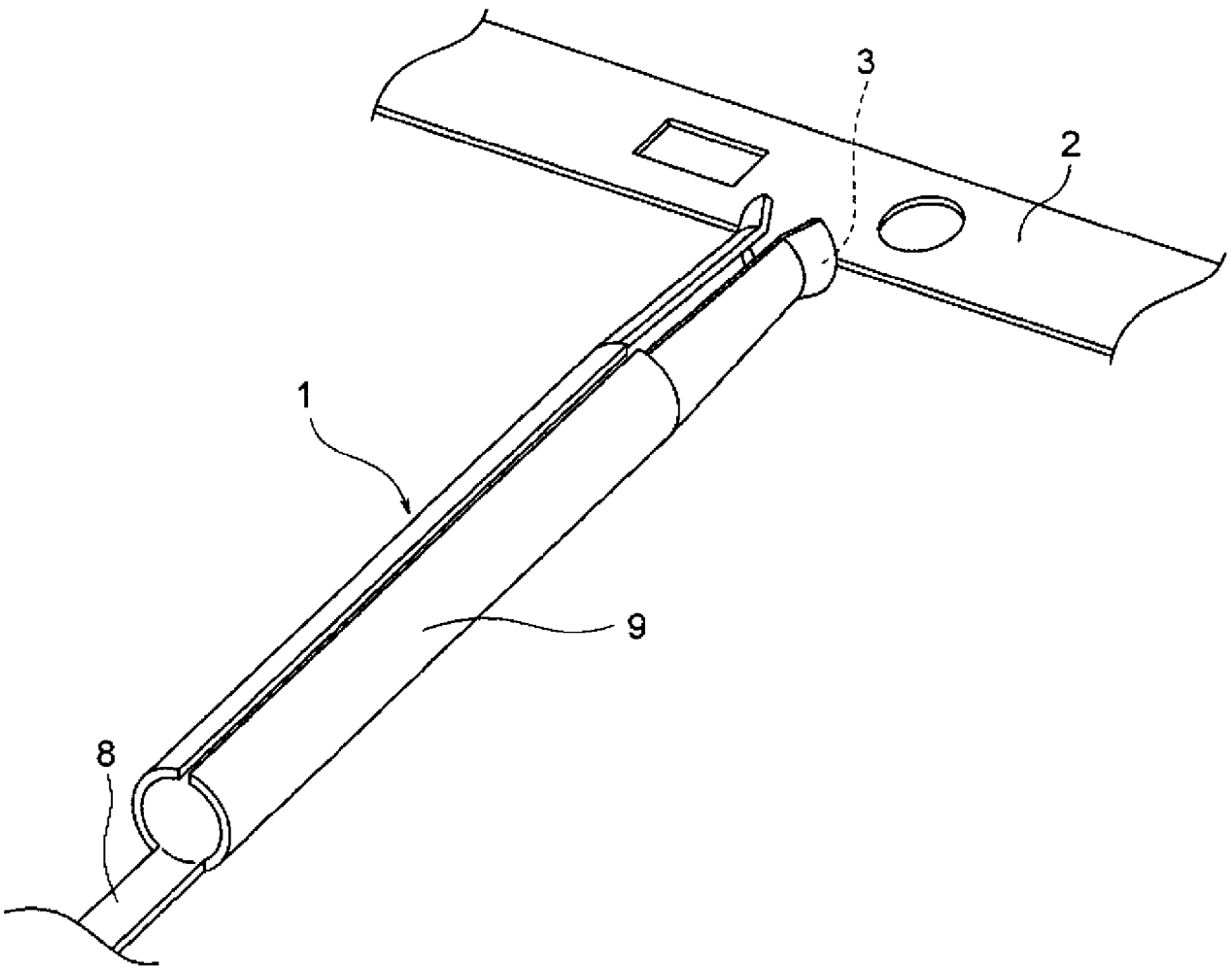
FIG. 6 is a perspective view of an inner terminal of a related art in a state where a connection position to the carrier is modified to an electric contact.

Each of the circuit board connection part 26 and the interconnecting part 27 is formed in an elongated plate-like shape. The circuit board connection part 26 is formed to be connected by a solder 24 to a signal pattern 28 of the circuit board 26. The circuit board connection part 26 is formed so that its front and rear sides are flat. The circuit board connection part 26 is not subjected to any other work during a period from the formation until the connection by the solder 24. That is, the plating remains in its entirety, and a fillet (see FIG. 4) is surely formed when the solder 24 is applied.

The interconnecting part 27 corresponds to a part which interconnects the electric contact 25 and the circuit board connection part 26, its one end being continuous to the electric contact 25 and the other end being continuous to the circuit board connection part 26. The interconnecting part 27 is formed by folding in a substantially L-shape including a horizontal part 29 extended along an axis of the electric contact 25 in parallel with the circuit board 22, and a vertical part 30 extended at right angles to the horizontal part 29 and the circuit board connection part 26.

An expanded part 31 for carrier-disconnection is integrally formed with the horizontal part 29. The expanded part 31 is formed to be expanded from opposite sides of the horizontal part 29. The expanded part 31 is formed in a plate shape having the same thickness as the horizontal part 29 and also having the front and rear sides which are flush with the horizontal part 29. The expanded part 31 is formed such that edges of the expansion serve as parts at which the inner terminal is disconnected from the carrier (described later) when the terminal is produced.

A shape of a planar view of the expanded part 31 includes various shapes such as a circle, an ellipse, an oval, a rectangle, or a square. The shape of the planar view is appropriately selected when adjusting its area.

An impedance when connector-mounted can be adjusted by adjusting the area of the expanded part 31. That is, the disturbance of the impedance is suppressed to the minimum by adjusting the area. For example, the area is adjusted to be reduced when a person wants to increase the impedance, while the area is increased when the person wants to decrease the impedance. In the embodiment, the area and the shape, etc are determined using simulation method and prototypes to have the best high frequency performance. Note that the minimum width of the expanded part 31 corresponds to a diameter of the electric contact 25 and the maximum width corresponds to a dimension by which the expanded part 31 is prevented from contact with an outer terminal (not shown in figures) configuring the coaxial connection 23 for circuit board.

Next, a description is made of the inner terminal 21 in a producing process with reference to FIG. 2.

The inner terminal 21 is subjected to a folding work, a plating and so on (known works are adopted, and their description is omitted) in a state where it is connected to a carrier 32. The inner terminal 21 is connected by a pair of terminal connection arms 33 extending from the carrier 32. The pair of terminal connection arms 33 extend along the axis direction of the inner terminal 21, and their edges are continuous to edges of the expanded part 31. A reference numeral 34 indicates a carrier-disconnection position (also referred to as a carrier-connection/disconnection part).

In the inner terminal 21 according to the embodiment, instead of the opposite sides of the thin interconnecting part 27, the edges of the expanded part 31 which are expand toward an external side (here, carrier-disconnection positions 34 which are located at positions apart farthest from the opposite sides of the interconnecting part 27) are connected to the terminal connection arms 33 of the carrier 32. Accordingly, a force occurred due to the disconnection when the inner terminal 21 is disconnected from the carrier 32 is not transmitted to a part of the solder 24 because of the strength of the expanded part 31. As a result, the deformation is not occurred (a load is not applied) in the part of the solder 24. Thus, the sufficient connection strength is ensured.

As described above with reference to FIG. 1 and FIG. 2, according to the inner terminal 21 of the embodiment, the carrier-disconnection position 34 is set on the expanded part 31 for carrier-disconnection. Thus, even if the inner terminal 21 is disconnected from the carrier 32, the plating of the circuit board connection part 26 is not disappeared. As a result, the connection strength according to the solder 24 with the circuit board 22 can be sufficiently ensured. That is, if the connection by solder 24 to the circuit board 22 is performed, the fillet 7 (see FIG. 4) is firmly formed. Therefore, it brings an advantage to enhance the reliability of the board connection than usual.

Further, according to the inner terminal 21 of the embodiment, the impedance can be adjusted by the expanded part 31 for carrier-disconnection. Accordingly, it brings an advantage to suppress the disturbance of the impedance to the minimum and enhance the high frequency characteristics than usual.

It is apparent that the various modifications is possible within the scope not changing the gist of the invention.

For example, the expanded part 31 may be provided on the vertical part 30 interconnecting part 27 instead of the horizontal part 29.

Industrial Applicability

According to the inner terminal of the invention, since the expanded part for carrier-disconnection is provided, it is possible to increase the reliability of the board connection and also enhance the frequency characteristics by appropriately adjusting the impedance.

REFERENCE SIGNS LIST

21: Inner terminal
22: Circuit board
23: Coaxial connector for circuit board
24: Soldering
25: Electric contact
26: Circuit board connection part
27: Interconnecting part
28: Signal pattern
29: Horizontal part
30: Vertical part
31: Expanded part
32: Carrier
33: Terminal connection arm
34: Carrier-disconnection position (carrier-connection/disconnection part)

The invention claimed is:

1. An inner terminal which configures a coaxial connector for a circuit board, which is to be provided on the circuit board, the inner terminal comprising:

an electric contact to be connected to a mating inner terminal, the electric contact formed as a tubular member;

a connection part to be soldered to the circuit board;

an interconnecting part which interconnects the electric contact and the connection part; and an expanded part for carrier-disconnection which is expanded from opposite sides of the interconnecting part, wherein edges of the expanded part serve as parts at which the inner terminal is disconnected from a carrier during a terminal-production, wherein a width of the expanded part is equal to or larger than a diameter of the electric contact.

2. The inner terminal according to claim 1, wherein the expanded part has a function of adjusting an impedance in accordance with its area.

3. The inner terminal according to claim 1, wherein the interconnecting part includes a horizontal part provided in parallel with the connection part, and a vertical part provided at right angles to the horizontal part.

4. The inner terminal according to claim 3, wherein the expanded part is located in the horizontal part of the interconnecting part.

5. The inner terminal according to claim 1, wherein the expanded part is the same in thickness as the interconnecting part and is flush with the interconnecting part.

6. The inner terminal according to claim 1, wherein the expanded part is formed of a circular shape.

7. The inner terminal according to claim 1, wherein the expanded part is formed of a rectangular shape.

* * * * *